US009753405B2

(12) United States Patent
Ishido

(10) Patent No.: US 9,753,405 B2
(45) Date of Patent: Sep. 5, 2017

(54) IMAGE FORMING APPARATUS

(71) Applicant: KYOCERA Document Solutions Inc., Osaka (JP)

(72) Inventor: Kohei Ishido, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/139,860

(22) Filed: Apr. 27, 2016

(65) Prior Publication Data

US 2016/0320724 A1 Nov. 3, 2016

(30) Foreign Application Priority Data

Apr. 28, 2015 (JP) ..... 2015-092140

(51) Int. Cl.
*G03G 15/00* (2006.01)
*G03G 15/08* (2006.01)

(52) U.S. Cl.
CPC ..... *G03G 15/0879* (2013.01); *G03G 15/0865* (2013.01); *G03G 2215/0132* (2013.01)

(58) Field of Classification Search
CPC ..... G03G 15/0889; G03G 15/0865; G03G 15/0879; G03G 2215/0132
See application file for complete search history.

(56) References Cited

U.S. PATENT DOCUMENTS

2014/0321866 A1* 10/2014 Tajima ..... G03G 21/1647 399/27

FOREIGN PATENT DOCUMENTS

JP 2010-204498 A 9/2010

* cited by examiner

*Primary Examiner* — David M Gray
*Assistant Examiner* — Michael Harrison
(74) *Attorney, Agent, or Firm* — Studebaker & Brackett PC

(57) ABSTRACT

A toner container is removably mounted in a housing of an image forming apparatus. The toner container contains a toner and has a stirring member for stirring the toner. An electric motor drives the stirring member. A storage device stores a required load value set for the toner container. A load detecting section includes an electric current sensor that measures a drive electric current of the electric motor. The load detecting section detects an actual load value of the electric motor in driving of the stirring member based on the drive electric current measured. A determination section compares the actual load value detected by the load detecting section with the required load value stored in the storage device and determines whether or not the actual load value coincides with the required load value to determine whether or not the toner container mounted in the housing is a genuine product.

20 Claims, 8 Drawing Sheets

IMAGE FORMING APPARATUS

INCORPORATION BY REFERENCE

The present application claims priority under 35 U.S.C. §119 to Japanese Patent Application No. 2015-092140, filed on Apr. 28, 2015. The contents of this application are incorporated herein by reference in their entirety.

BACKGROUND

The present disclosure relates to image forming apparatuses for forming an image on a recording medium (for example, paper).

An image forming apparatus forms an image on paper through transfer of a toner image onto the paper. The image forming apparatus therefore includes a toner container for supplying toner. The toner container is removably mounted in a main body of the image forming apparatus.

The image forming apparatus identifies a toner container mounted in the main body as genuine or not genuine using a radio tag (for example, Radio Frequency Identification (RFID)). More specifically, the image forming apparatus includes a radio tag and a tag reader circuit. The radio tag is attached to the toner container and includes information about the toner container as tag information. The tag reader circuit is disposed on the main body. The tag reader circuit reads the tag information from the radio tag of the toner container mounted in the main body and identifies the toner container as genuine or not genuine based on the tag information that is read.

SUMMARY

An image forming apparatus according to an aspect of the present disclosure includes a housing, a toner container, an electric motor, a storage device, a load detecting section, and a determination section. The toner container is removably mounted in the housing and contains a toner. The toner container has a stirring member for stirring the toner. The electric motor drives the stirring member. The storage device stores a required load value set for the toner container. The load detecting section includes an electric current sensor that measures a drive electric current of the electric motor. The load detecting section detects an actual load value of the electric motor in driving of the stirring member based on the drive electric current measured. The determination section compares the actual load value detected by the load detecting section with the required load value stored in the storage device and determines whether or not the actual load value coincides with the required load value to determine whether or not the toner container mounted in the housing is a genuine product.

DETAILED DESCRIPTION

Figure 1:
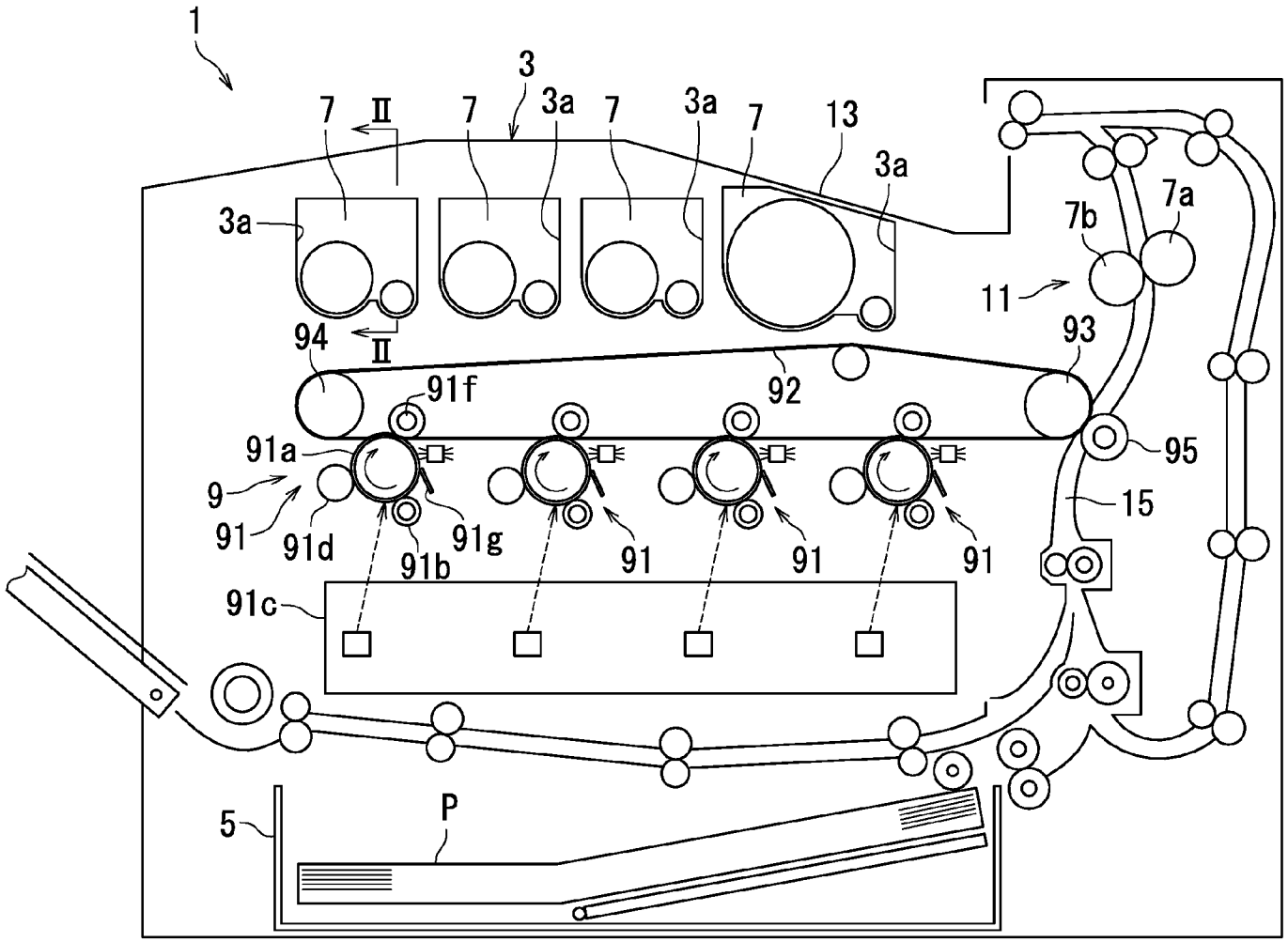
FIG. 1 is a cross-sectional view of an image forming apparatus according to an embodiment of the present disclosure.

The following describes an embodiment of the present disclosure with reference to the accompanying drawings. Elements in the drawings that are the same or equivalent are marked by the same reference signs, and description of such elements is not repeated.

<Description of Configuration>

The following describes an image forming apparatus according to an embodiment of the present disclosure with reference to FIG. 1. FIG. 1 is a cross-sectional view of the image forming apparatus according to the present embodiment.

An image forming apparatus 1 according to the present embodiment forms an image on paper P by forming a toner image on the paper P. The image forming apparatus 1 includes a housing (apparatus main body) 3, a paper feed cassette 5, a plurality of toner containers 7, an image forming section 9, a fixing section 11, an exit tray 13, and a paper conveyance path 15.

The paper feed cassette 5 feeds the paper P to the image forming section 9. The paper feed cassette 5 is for example disposed in a lower section of the housing 3. The paper feed cassette 5 accommodates a stack of a plurality of sheets of paper P.

The plurality of toner containers 7 correspond to a plurality of colors (for example, cyan, magenta, yellow, and black) and supply toners of a plurality of colors to the image forming section 9. The plurality of toner containers 7 are for example disposed in a row in an upper section of the housing 3. The respective toner containers 7 are removably mounted in mounting sections 3*a* of the housing 3.

The image forming section 9 forms an image on paper P fed by the paper feed cassette 5 using the toners of the different colors supplied by the respective toner containers 7. The image forming section 9 is disposed between the paper feed cassette 5 and the toner containers 7 in the housing 3. More specifically, the image forming section 9 includes a plurality of image forming units 91, an intermediate transfer belt 92, a drive roller 93, a driven roller 94, and a secondary transfer roller 95.

The plurality of image forming units 91 are disposed in one-to-one correspondence with the plurality of toner containers 7. Each of the image forming units 91 receives a toner from a corresponding one of the toner containers 7. The image forming units 91 form on a surface of the intermediate transfer belt 92 toner images of the respective colors based on image information. The toner images of the respective colors are superimposed on one another. As a result, a color toner image is formed on the surface of the intermediate transfer belt 92.

Each of the image forming units 91 includes a photosensitive drum 91*a*, a charger 91*b*, a light exposure device 91*c*, a developing device 91*d*, a primary transfer roller 91*f*, and a cleaning device 91*g*.

A surface of the photosensitive drum 91*a* includes a photosensitive layer. The charger 91*b* uniformly charges the surface of the photosensitive drum 91*a* to a specific electric potential. The light exposure device 91*c* irradiates the charged surface of the photosensitive drum 91*a* with laser light. As a result, the light exposure device 91*c* forms an electrostatic latent image based on image information on the surface of the photosensitive drum 91*a*. The developing device 91*d* develops the electrostatic latent image on the surface of the photosensitive drum 91*a* into a toner image using the toner supplied from the corresponding toner container 7.

The primary transfer roller 91*f* transfers the toner image from the surface of the photosensitive drum 91*a* to the surface of the intermediate transfer belt 92. The primary transfer roller 91*f* is supported so as to press the photosensitive drum 91*a* with the intermediate transfer belt 92 therebetween. A primary transfer voltage is applied to a surface of the primary transfer roller 91*f* As a result, the toner image on the surface of the photosensitive drum 91*a* is transferred to the intermediate transfer belt 92 by electrostatic attractive force of the primary transfer roller 91*f* when pressed against the intermediate transfer belt 92. The cleaning device 91*g* removes residual toner remaining on the surface of the photosensitive drum 91*a* after the image transfer.

The intermediate transfer belt 92 conveys the color toner image on the surface thereof to the secondary transfer roller 95. The intermediate transfer belt 92 is an endless belt and is wound around the drive roller 93 and the driven roller 94. The intermediate transfer belt 92 circulates through rotational drive of the drive roller 93. The circulating intermediate transfer belt 92 conveys the color toner image thereon to the secondary transfer roller 95.

The secondary transfer roller 95 transfers the color toner image from the surface of the intermediate transfer belt 92 to the paper P. The secondary transfer roller 95 is supported so as to press the drive roller 93 with the intermediate transfer belt 92 therebetween. A secondary transfer voltage is applied to the secondary transfer roller 95. Consequently, as the color toner image on the surface of the intermediate transfer belt 92 and the paper P simultaneously pass through a contact region (a secondary transfer nip) between the drive roller 93 and the secondary transfer roller 95, the color toner image is transferred to the paper P by electrostatic attractive force of the secondary transfer roller 95. The drive roller 93 and the secondary transfer roller 95 are equivalent to "conveyance rollers" and convey the paper P having the color toner image transferred thereto.

The fixing section 11 fixes the transferred color toner image to the paper P. The fixing section 11 includes a pressure roller 7*a* and a fixing roller 7*b*. The fixing roller 7*b* has a heat source for heating the paper P. The pressure roller 7*a* and the fixing roller 7*b* are in pressed contact with one another. As the paper P having the color toner image transferred thereto passes through a contact region (fixing nip) between the pressure roller 7*a* and the fixing roller 7*b*, the color toner image is fixed to the paper P through heating by the fixing roller 7*b*. The paper P having the color toner image fixed thereto is discharged onto the exit tray 13.

The exit tray 13 is for example disposed on a top surface of the housing 3.

The paper conveyance path 15 extends from the paper feed cassette 5 to the exit tray 13 through the secondary transfer nip and the fixing nip in stated order. The paper P in the paper feed cassette 5 is conveyed along the paper conveyance path 15 and discharged onto the exit tray 13 after passing through the secondary transfer nip and the fixing nip in stated order.

The housing 3 has the plurality of mounting sections 3*a* and a toner container cover (not illustrated). The mounting sections 3*a* are in one-to-one correspondence with the toner colors (for example, cyan, magenta, yellow, and black). The toner containers 7 are removably mounted in the mounting sections 3*a* in one-to-one correspondence in terms of color. The toner container cover is openable and closable relative to the housing 3. The toner container cover opens and closes a mounting opening of each of the mounting sections 3*a*.

Figure 2:
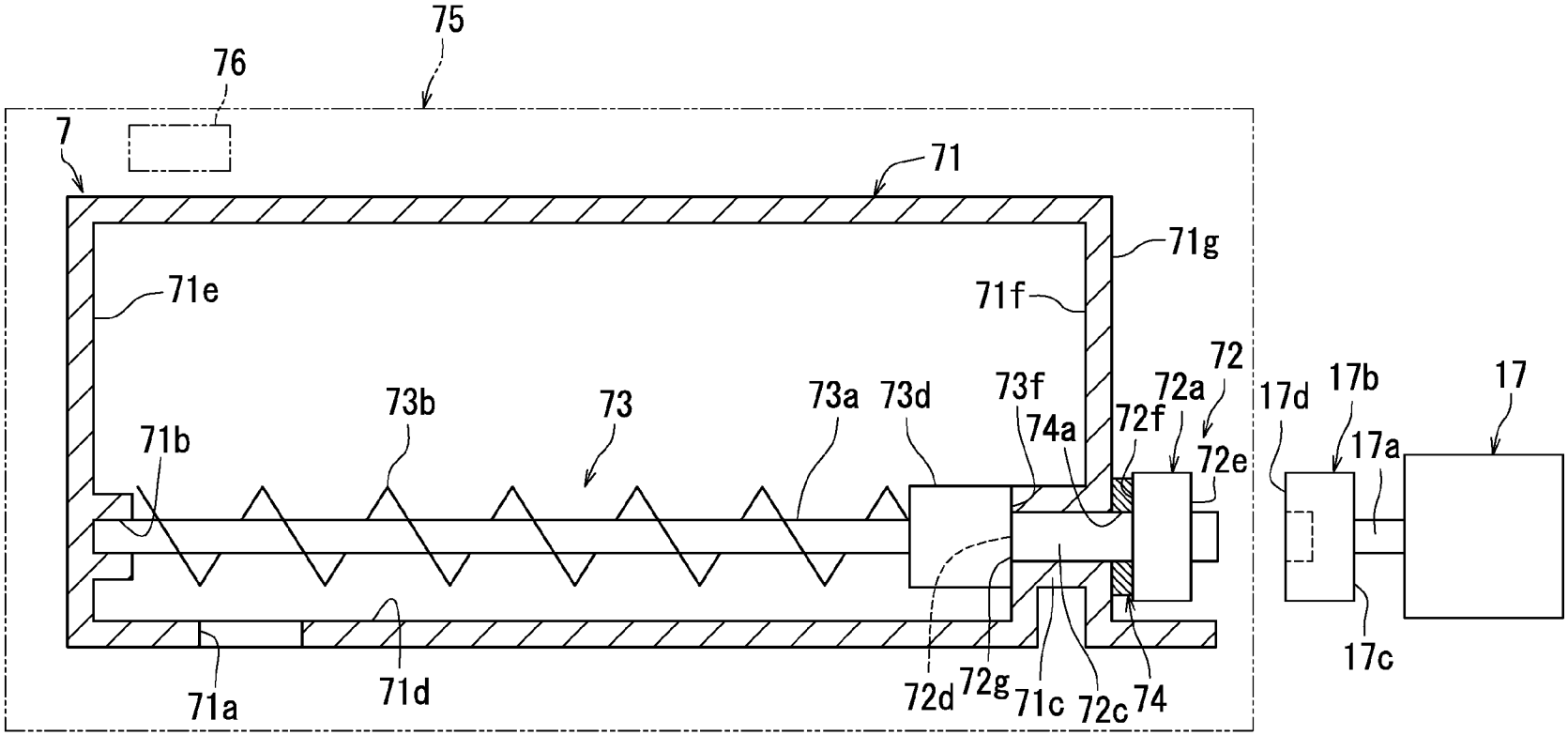
FIG. 2 is a cross-sectional view taken along line II-II in FIG. 1.

The following describes configuration of the toner containers 7 with reference to FIG. 2. FIG. 2 is a cross-sectional view taken along line II-II in FIG. 1. As illustrated in FIG. 2, the image forming apparatus 1 further includes motors 17 (electric motor) in addition to the toner containers 7. The motors 17 are drive sources for stirring the toners in the respective toner containers 7. The motors 17 will be described later in detail.

Each of the toner containers 7 includes a container main body 71, a coupling member 72, a stirring member 73, a torque limiter 74, a packing 75, and a label 76.

The container main body 71 contains a toner. The container main body 71 is removably mounted in the corresponding mounting section 3*a* of the housing 3. The container main body 71 for example has a horizontally long rectangular box shape. The container main body 71 has a toner discharge outlet 71*a*, a bearing bore 71*b*, and a bushing 71*c*.

The toner discharge outlet 71*a* is provided at an end of a bottom face 71*d* of the container main body 71 in a longitudinal direction. The bearing bore 71*b* rotatably supports an end portion of the stirring member 73. The bearing bore 71*b* is provided on an inner end surface 71*e* of the container main body 71. The inner end surface 71*e* is an inner end surface at one end of the container main body 71 in the longitudinal direction. The bushing 71*c* supports a rotatable shaft 72*c* of the coupling member 72. The bushing 71*c* protrudes from an inner end surface 71*f* of the container main body 71. The inner end surface 71*f* is an inner end surface at the other end of the container main body 71 in the longitudinal direction. The bushing 71*c* penetrates through an outer end surface 71*g* of the container main body 71. The outer end surface 71*g* is an outer end surface at the other end of the container main body 71 in the longitudinal direction.

The coupling member 72 is attached to the other end portion of the stirring member 73 such that the coupling member 72 is concentric with the stirring member 73 and rotatable integrally with the stirring member 73. The coupling member 72 is removably attached to a rotatable shaft 17*a* of the motor 17. The coupling member 72 has a coupling portion 72*a* and the rotatable shaft 72*c*.

The coupling portion 72*a* is removably attached to the rotatable shaft 17*a* of the motor 17. The rotatable shaft 72*c* protrudes from one end surface 72*f* of the coupling portion 72*a* so as to be concentric with the coupling portion 72*a* and rotatable integrally with the coupling portion 72*a*. The other end surface 72*e* of the coupling portion 72*a* is removably attached to the rotatable shaft 17*a* of the motor 17. The coupling portion 72*a* is concentric with the rotatable shaft 17*a* and rotatable integrally with the rotatable shaft 17*a*. The rotatable shaft 72*c* is inserted into the bushing 71*c* from outside of the container main body 71. As a result, the rotatable shaft 72*c* is rotatably supported by the bushing 71*c*. An end portion 72*d* of the rotatable shaft 72*c* is located inward of the container main body 71 and attached to the stirring member 73 such that the rotatable shaft 72*c* is concentric with the stirring member 73 and rotatable integrally with the stirring member 73.

The stirring member 73 stirs the toner contained in the container main body 71. The stirring member 73 conveys the toner toward the toner discharge outlet 71*a*. The stirring member 73 is attached to the coupling member 72 so as to be concentric with the coupling member 72 and rotatable integrally with the coupling member 72. The stirring member 73 is rotatably supported in the container main body 71.

The stirring member 73 has a rotatable shaft 73*a*, a stirring fin 73*b*, and a coupling portion 73*d*. The coupling portion 73*d* is disposed at one end portion of the rotatable shaft 73*a* such that the coupling portion 73*d* is concentric with the rotatable shaft 73*a* and rotatable integrally with the rotatable shaft 73*a*. The end portion 72*d* of the rotatable shaft 72*c* is attached to an end surface 73*f* of the coupling portion 73*d* such that the rotatable shaft 72*c* is concentric with the coupling portion 73*d* and rotatable integrally with the coupling portion 73*d*. The stirring member 73 is therefore concentric with the coupling member 72 and rotatable integrally with the coupling member 72. The stirring fin 73*b* has a helical shape on a constant pitch and is disposed around an outer circumference of the rotatable shaft 73*a*. The stirring fin 73*b* extends from the one end to the other end of the rotatable shaft 73*a*.

The other end portion of the rotatable shaft 73*a* rotatably fits in the bearing bore 71*b* of the container main body 71. The coupling portion 73*d* is attached to the rotatable shaft 72*c* of the coupling member 72 so as to be concentric with the rotatable shaft 72*c* and rotatable integrally with the rotatable shaft 72*c*. As a result, the stirring member 73 is rotatably supported in the container main body 71.

In the toner container 7, rotation of the coupling member 72 caused by the motor 17 causes rotation of the stirring member 73. The rotating stirring member 73 stirs the toner contained in the container main body 71. As a result, the toner is conveyed toward the toner discharge outlet 71*a*. The thus conveyed toner is discharged through the toner discharge outlet 71*a*. The discharged toner is then supplied to the corresponding image forming unit 91.

The torque limiter 74 allows rotation of the stirring member 73 only when a rotational force (torque) that is no less than a specific threshold value Ts is applied to the stirring member 73. The torque limiter 74 is for example a member that generates frictional resistance and has an annular shape including a through hole 74*a*. The through hole 74*a* of the torque limiter 74 receives the rotatable shaft 72*c* of the coupling member 72. The torque limiter 74 is disposed between the end surface 72*f* of the coupling member 72 and the outer end surface 71*g* of the container main body 71.

Upon application of a rotational force to the coupling member 72, frictional resistance R1 is generated at an interface between the torque limiter 74 and the coupling member 72. Furthermore, frictional resistance R2 is generated at an interface between the torque limiter 74 and the container main body 71. Hereinafter, the smaller value of a maximum value of the frictional resistance R1 and a maximum value of the frictional resistance R2 may be referred to as a specific frictional resistance value. When a rotational force smaller than the specific frictional resistance value is applied to the coupling member 72, the frictional resistance R1 and the frictional resistance R2 prevent rotation of the coupling member 72. As a result, rotation of the stirring member 73 is prevented. When a rotational force no less than the specific frictional resistance value is applied to the coupling member 72, the rotational force causes rotation of the coupling member 72. As a result, rotation of the stirring member 73 is caused.

The smaller value of the maximum value of the frictional resistance R1 and the maximum value of the frictional resistance R2 is the specific threshold value Ts. The maximum value of the frictional resistance R1 and the maximum value of the frictional resistance R2 can be adjusted to any values by changing the thickness or the material of the torque limiter 74. Thus, the specific threshold value Ts is adjustable to any value depending on the torque limiter 74. In the present embodiment, the specific threshold value Ts is set to a value selected from among a plurality of values (for example, four values: 10N·m, 20N·m, 30N·m, and 40N·m).

The torque limiter 74 may be disposed between the end surface 73*f* of the stirring member 73 and the bushing 71*c* of the container main body 71.

The packing 75 surrounds the container main body 71. Before the toner container 7 is mounted in the corresponding mounting section 3*a* of the image forming apparatus 1, the container main body 71 is taken out of the packing 75. The container main body 71 is then mounted in the mounting section 3*a*. The packing 75 is for example formed from corrugated board or cardboard.

A value of a required load torque (required load value) set for the toner container 7 is printed on the label 76. The required load torque is a load torque required in order that the motor 17 causes the stirring member 73 of the toner container 7 having the label 76 to rotate at a specific rotational speed. The label 76 is for example a sticker. The label 76 may be provided on a surface of the packing 75 or may be provided on a surface of the container main body 71.

The value of the required load torque is a sum of the specific threshold value Ts and a value of stirring resistance. The stirring resistance refers to resistance (torque) that the stirring member 73 receives from the toner during rotation of the stirring member 73. As mentioned above, the specific threshold value Ts is adjustable to any value depending on the torque limiter 74. Accordingly, the value of the required load torque is adjustable to any value depending on the torque limiter 74.

In a configuration in which a plurality of required load torque values different from toner container 7 to toner container 7 are used, therefore, the required load torque values can have a sufficiently large difference therebetween. Consequently, in the image forming apparatus 1, the required load torque values can be distinguished from one another without confusion. Furthermore, the use of a plurality of required load torque values different from toner container 7 to toner container 7 leaves the possibility that one of the required load torque values may come to another manufacturer's knowledge but substantially eliminates the possibility that all the required load torque values come to another manufacturer's knowledge. Thus, spreading of non-genuine products that are identified as genuine products can be restricted.

The required load torque is for example printed on the label 76 at a manufacturing facility of the toner container 7. More specifically, the stirring member 73 of the toner container 7 is caused to rotate by the motor 17 in the final stage of manufacture of the toner container 7 at the manufacturing facility. Then, an actual load torque of the motor 17 is detected. The thus detected value is printed on the label 76 as the value of the required load torque.

As mentioned above, the image forming apparatus 1 includes the motors 17. The motors 17 are disposed in the housing 3. The motors 17 cause rotation of the stirring members 73 of the respective toner containers 7 mounted in the housing 3. The individual motors 17 are provided for each of the toner containers 7.

Each of the motors 17 has the rotatable shaft 17*a* and a coupling portion 17*b*. The rotatable shaft 17*a* generates rotational force of the motor 17. An end of the rotatable shaft 17*a* is attached to one end surface 17*c* of the coupling portion 17*b* such that the rotatable shaft 17*a* is concentric with the coupling portion 17*b* and rotatable integrally with the coupling portion 17*b*. The end surface 72*e* of the coupling portion 72*a* of the toner container 7 is removably attached to the other end surface 17*d* of the coupling portion 17*b* such that the coupling portion 72*a* is concentric with the coupling portion 17*b* and rotatable integrally with the coupling portion 17*b*.

Although the coupling portion 17*b* is directly attached to the rotatable shaft 17*a* of the motor 17 in the present embodiment, a reduction gear may be provided between the rotatable shaft 17*a* and the coupling portion 17*b*.

The coupling member 72 of the toner container 7 and the coupling portion 17*b* of the motor 17 are removably attached to one another so as to be concentric with one another and rotatable integrally with one another, with the toner container 7 removably mounted in the corresponding mounting section 3*a* of the housing 3. As a result, the rotational force generated from the rotatable shaft 17*a* of the motor 17 is applied to the stirring member 73 via the coupling portion 17*b* and the coupling member 72.

Figure 3:
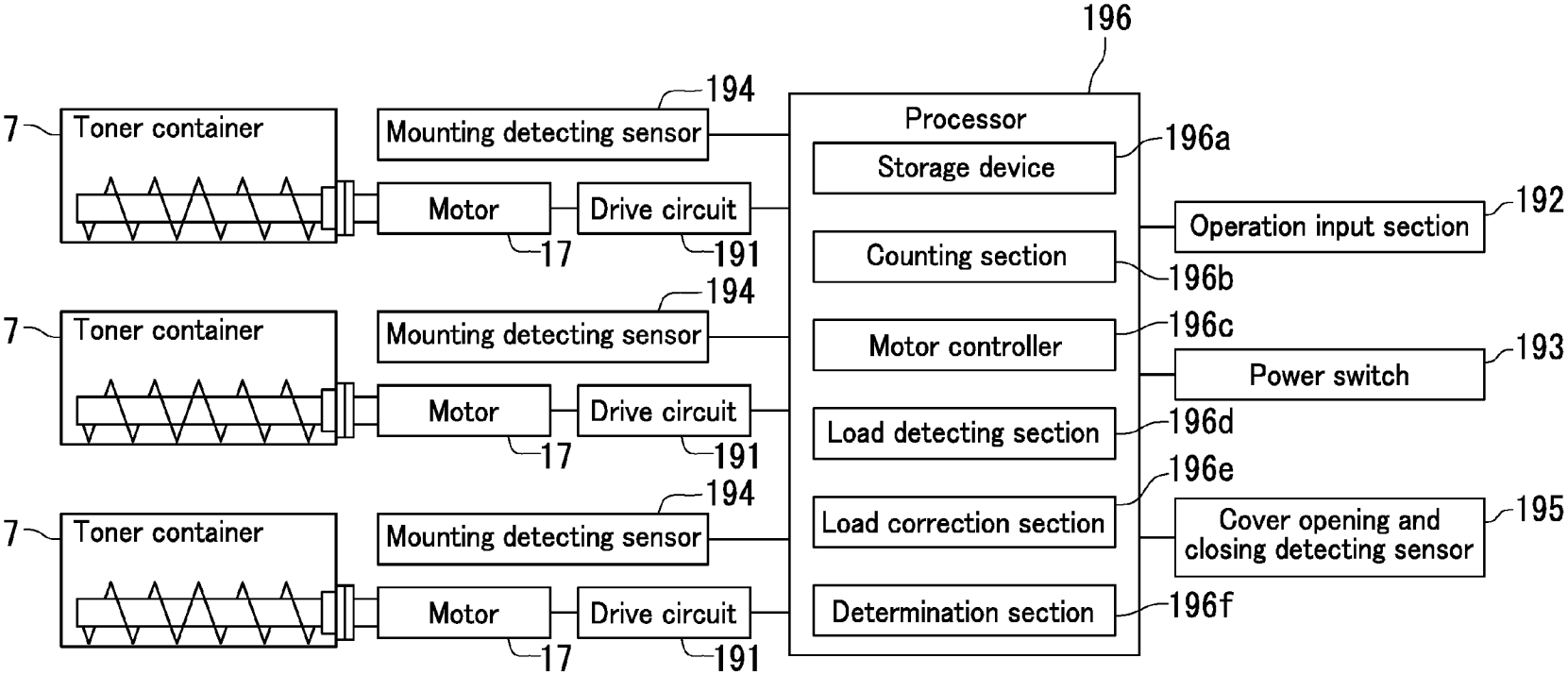
FIG. 3 is a schematic view illustrating main elements of configuration of an electric system of the image forming apparatus according to the embodiment of the present disclosure.
Figure 4:
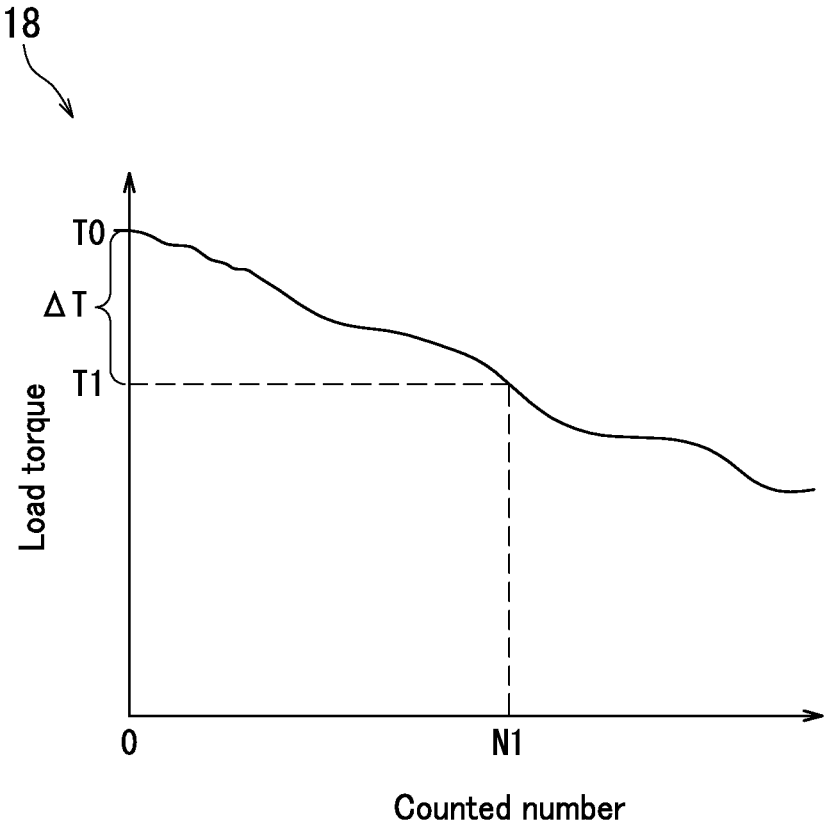
FIG. 4 is a diagram showing a correspondence table relating load torque to counted number.

The following describes main elements of configuration of an electric system of the image forming apparatus 1 with reference to FIGS. 3 and 4. FIG. 3 is a schematic view illustrating main elements of configuration of an electric system of the image forming apparatus 1 according to the present embodiment. FIG. 4 is a diagram showing an example of a correspondence table relating load torque to counted number.

The image forming apparatus 1 includes, as main elements of configuration of its electric system, a plurality of drive circuits 191, an operation input section 192, a power switch 193, a plurality of mounting detecting sensors 194, a cover opening and closing detecting sensor 195, and a processor 196 in addition to the plurality of motors 17.

The drive circuits 191 supply drive electric current to the plurality of motors 17 under control by the processor 196. The individual drive circuits 191 are provided for each of the motors 17.

The operation input section 192 receives input of a value of the required load torque. The value of the required load torque is printed on the label 76 of a toner container 7 to be mounted in the image forming apparatus 1. A user inputs the value of the required load torque into the operation input section 192 in association with toner color information when mounting the toner container 7 in the image forming apparatus 1. The toner color is a color of the toner contained in the toner container 7.

More specifically, the operation input section 192 has selection buttons and operation buttons. The selection buttons are used for selecting a toner color. The operation buttons are used for inputting a value of the required load torque. The user operates the selection buttons to select the toner color of the toner container 7 and operates the operation buttons to input the value of the required load torque printed on the label 76 of the toner container 7 when mounting the toner container 7 in the image forming apparatus 1. In response, the operation input section 192 associates the input toner color information with the input value of required load torque and outputs the toner color information and the value of the required load torque to the processor 196.

The operation input section 192 for example has a touch panel or hard keys. The operation input section 192 is able to display on the touch panel an operation screen including the selection buttons and the operation buttons in response to a touch operation on the touch panel.

The power switch 193 receives input of switching operation for turning on and off a power of the image forming apparatus 1. The power switch 193 turned on outputs an on signal to the processor 196 and the power switch turned off outputs an off signal to the processor 196.

The mounting detecting sensors 194 detect whether or not the toner containers 7 are mounted in the respective mounting sections 3*a* of the image forming apparatus 1. The individual mounting detecting sensors 194 are disposed at each of the mounting sections 3*a*. The mounting detecting sensors 194 for example include pushbuttons of an autonomous recovery type. When a toner container 7 is mounted in the mounting section 3*a*, the corresponding mounting detecting sensor 194 is pushed by the toner container 7 and thus turned on to output an on signal to the processor 196. When the toner container 7 is removed from the mounting section 3*a*, the mounting detecting sensor 194 is released and thus turned off to output an off signal to the processor 196.

The cover opening and closing detecting sensor 195 detects opening and closing of the toner container cover. The cover opening and closing detecting sensor 195 for example includes a pushbutton of an autonomous recovery type and is disposed on the housing 3. When the toner container cover is in a closed state, the cover opening and closing detecting sensor 195 is pushed by the toner container cover and thus turned on to output an on signal to the processor 196. When the toner container cover is in an open state, the cover opening and closing detecting sensor 195 is released and thus turned off to output an off signal to the processor 196.

The processor 196 controls each of the motors 17. Furthermore, the processor 196 determines whether or not each toner container 7 that is being driven by the corresponding motor 17 is a genuine product based on an actual load torque of the motor 17. In the present embodiment, the determination is for example made upon power-up of the image forming apparatus 1 or upon opening or closing of the toner container cover.

The processor 196 includes a storage device 196*a*, a counting section 196*b*, a motor controller 196*c*, a load detecting section 196*d*, a load correction section 196*e*, and a determination section 196*f*. The processor 196 is for example a central processing unit (CPU), a microprocessor unit (MPU), or an application-specific integrated circuit (ASIC).

The storage device 196*a* is for example a non-volatile storage device such as read only memory (ROM) and a magnetic-storage device. The storage device 196*a* stores a toner color and a required load torque value in association with one another. The operation input section 192 outputs the toner color and the required load torque value.

Once a toner container 7 is mounted, the counting section 196*b* continuously counts the number of sheets of paper P on which an image has been formed using the toner in the toner container 7. For example, the counting section 196*b* counts the number of sheets of paper P on which normal printing or calibration printing has been performed using the toner in the toner container. The counting section 196*b* stores the counted number in the storage device 196*a*. The counting section 196*b* determines that the toner container 7 has been mounted when the output signal from the mounting detecting sensor 194 has changed from an off signal to an on signal.

The motor controller 196*c* controls each of the drive circuits 191 to start or stop the corresponding motor 17. The motor controller 196*c* controls each of the drive circuits 191 to start the corresponding motor 17 every time the corresponding image forming unit 91 consumes the toner. Through the above, the stirring member 73 of each toner container 7 rotates to supply the toner from the toner container 7 to the corresponding image forming unit 91.

The motor controller 196*c* controls each of the drive circuits 191 to start the corresponding motor 17 upon the power switch 193 being turned on or upon opening or closing of the toner container cover. Through the above, each of the motors 17 causes rotation of the stirring member 73 of the corresponding toner container 7, and detection by the load detecting section 196*d* is performed.

The motor controller 196*c* determines that the power switch 193 has been turned on when the output signal from the power switch 193 has changed from an off signal to an on signal. Furthermore, the motor controller 196*c* determines that the toner container cover has been opened when the output signal from the cover opening and closing detecting sensor 195 has changed from an on signal to an off signal. Likewise, the motor controller 196*c* determines that the toner container cover has been closed when the output signal from the cover opening and closing detecting sensor 195 has changed from an off signal to an on signal.

The load detecting section 196*d* measures drive electric current of each motor 17 and detects an actual load torque of the motor 17 based on the drive electric current measured. The load detecting section 196*d* for example includes an electric current sensor. More specifically, the electric current sensor measures drive electric current of each motor 17 upon the power switch 193 being turned on or upon opening or closing of the toner container cover. Through the above, the load detecting section 196*d* detects the actual load torque of the motor 17 while the motor 17 is causing rotation of the stirring member 73. More specifically, the load detecting section 196*d* for example determines the actual load torque from the measured drive electric current based on a correspondence table relating drive electric current to actual load torque. The correspondence table is for example stored in the storage device 196*a*.

The load correction section 196*e* corrects the value of the required load torque stored in the storage device 196*a* based on the number counted by the counting section 196*b*. The value of the required load torque is a value when the toner in the toner container 7 is yet to be used (i.e., when the counted number is zero). As the toner in the toner container 7 is consumed, the stirring resistance that is received by the stirring member 73 decreases. As a result, a difference is introduced between the required load torque and the actual load torque. The value of the required load torque therefore needs to be corrected to a value for the current toner consumption state of the toner container 7 (e.g., when the number counted is the latest value (for example, N1)).

More specifically, the value of the required load torque is stored in the storage device 196*a* in association with a toner color. The load correction section 196*e* corrects the value of the required load torque based on the number counted with respect to the toner container 7 of the toner color associated with the required load torque.

More specifically, a correspondence table 18 (variation table) relating load torque to counted number as illustrated in FIG. 4 is stored in the storage device 196*a*. The correspondence table 18 predefines variation of the load torque depending on the counted number. In the correspondence table 18, the vertical axis represents load torque and the horizontal axis represents counted number. The correspondence table 18 can be created through experiments. The load correction section 196*e* retrieves the latest counted number (for example, N1) from the storage device 196*a*. The load correction section 196*e* then determines a difference ΔT between a value T1 of the load torque and a value T0 of the load torque based on the correspondence table 18. The value T1 is a value of the load torque when the counted number is N1. The value T0 is a value of the load torque when the counted number is zero. The load correction section 196*e* then subtracts the difference ΔT from the value Ta of the required load torque to determine a value Tb (=Ta−ΔT) of the required load torque for the current toner consumption state. The thus determined value Tb is a value of the corrected required load torque.

As described above, the value of the required load torque is corrected in view of variation depending on the counted number. As a result, whether or not the toner container 7 is a genuine product can be determined more accurately. The variability cannot be easily modeled on. It is therefore difficult to manufacture a non-genuine product having the same variability as the genuine product. Thus, manufacture of non-genuine products that are determined to be genuine products can be restricted.

The determination section 196*f* determines whether or not each toner container 7 mounted in the image forming apparatus 1 is a genuine product based on a result of detection by the load detecting section 196*d* and a result of correction by the load correction section 196*e*.

More specifically, with respect to each of the toner containers 7, the determination section 196*f* compares a value Tr of the actual load torque detected by the load detecting section 196*d* with a value Tb of the required load torque corrected by the load correction section 196*e* and determines whether or not the value Tr coincides with the value Tb.

The determination section 196*f* determines whether or not the value Tr coincides with the value Tb within a predetermined tolerance D. Provision of the tolerance D reduces the possibility that the result of determination by the determination section 196*f* is affected by non-constant variation of the actual load torque depending on toner consumption. More specifically, the determination section 196*f* determines whether or not the actual load torque Tr satisfies relational expression (1) shown below.

$$Tb-D<Tr<Tb+D \quad (1)$$

With respect to each of the toner containers 7, the determination section 196*f* determines that the toner container 7 is a genuine product if the value Tb coincides with the value Tr within the tolerance D (i.e., if the relational expression (1) is satisfied). If the value Tr does not coincide with the value Tb (i.e., if the relational expression (1) is not satisfied), the determination section 196*f* determines that the toner container 7 is not a genuine product (i.e., the toner container 7 is a non-genuine product).

As described above, whether or not the toner container 7 is a genuine product is determined based on the value of the required load torque stored in the storage device 196*a* and the value of the actual load torque of the motor 17. Since the need for the traditionally used radio tag and tag reader circuit is eliminated, it is possible to identify a toner container 7 as genuine or non-genuine with a simple configuration.

<Description of Operation>

Figure 5:
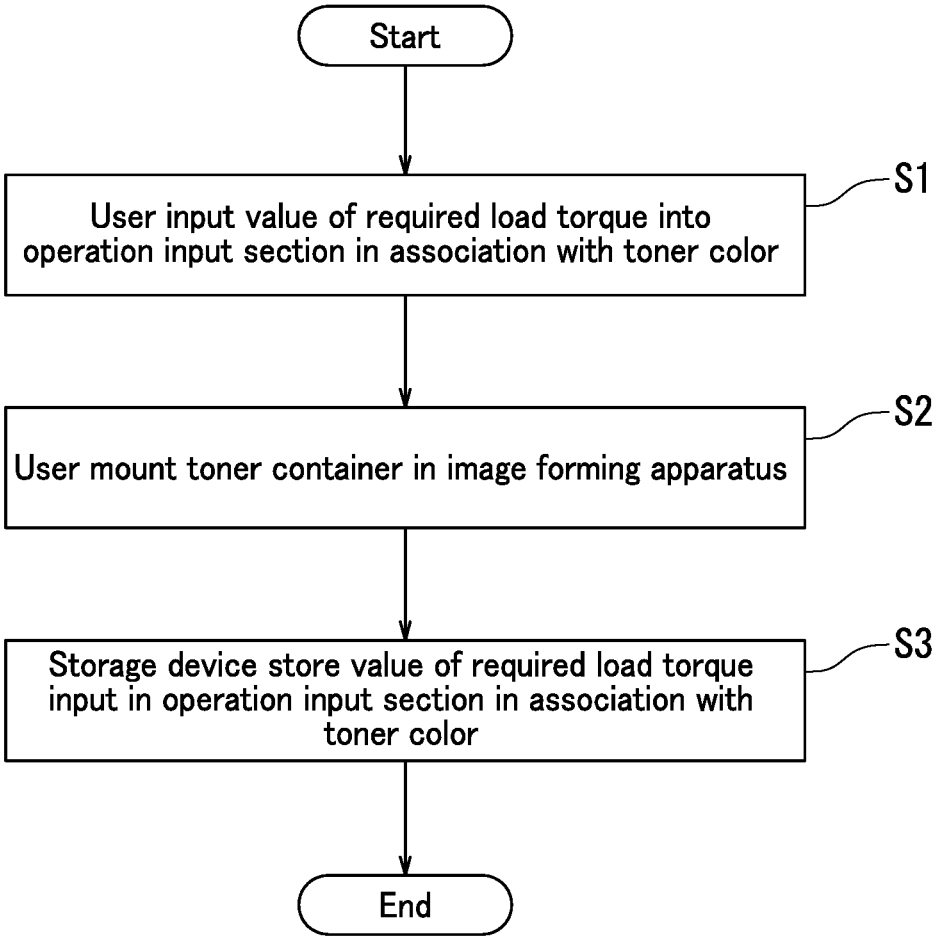
FIG. 5 is a flowchart illustrating a procedure for attaching a toner container to the image forming apparatus.
Figure 6:
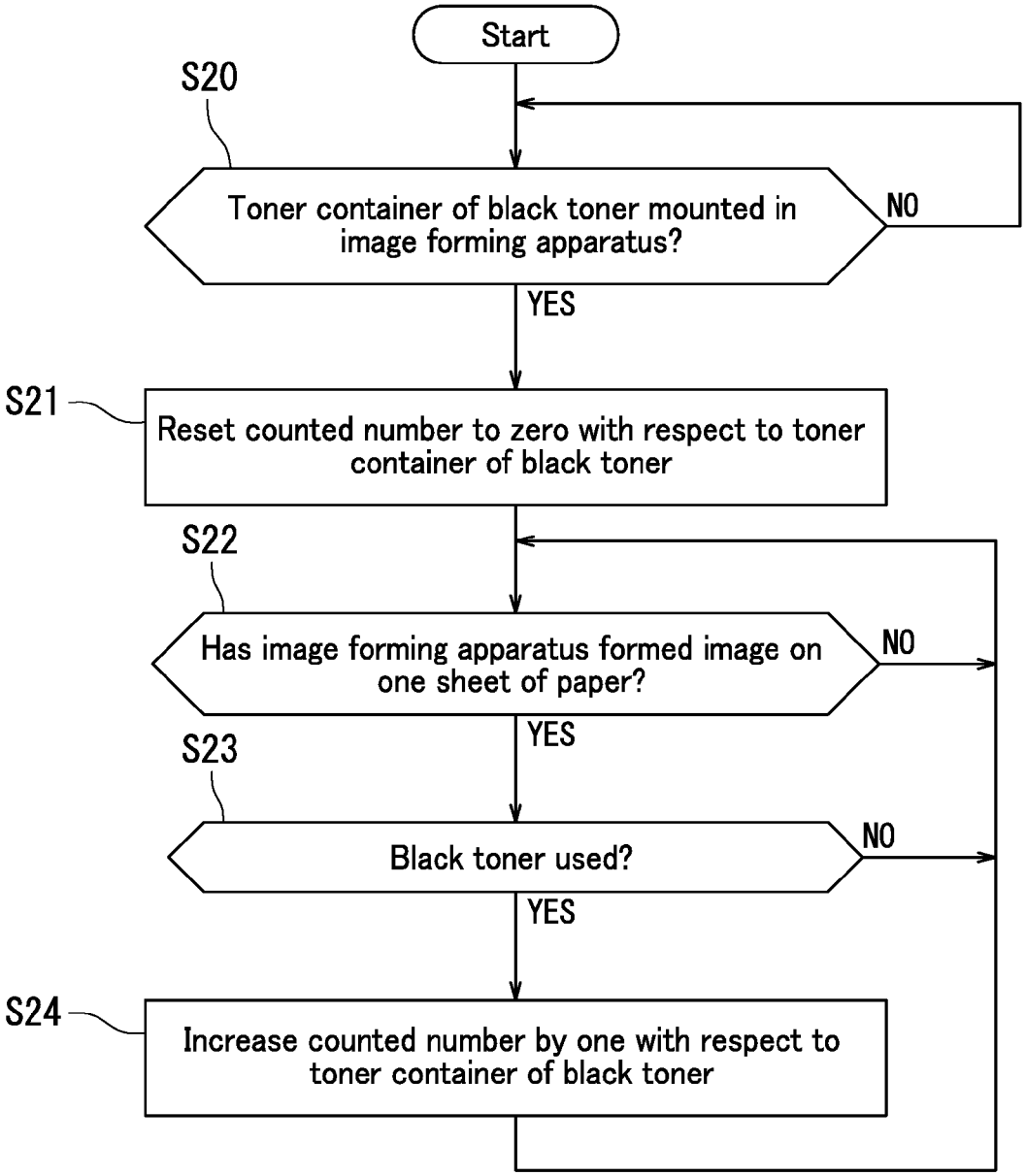
FIG. 6 is a flowchart illustrating operation of a counting section.
Figure 7:
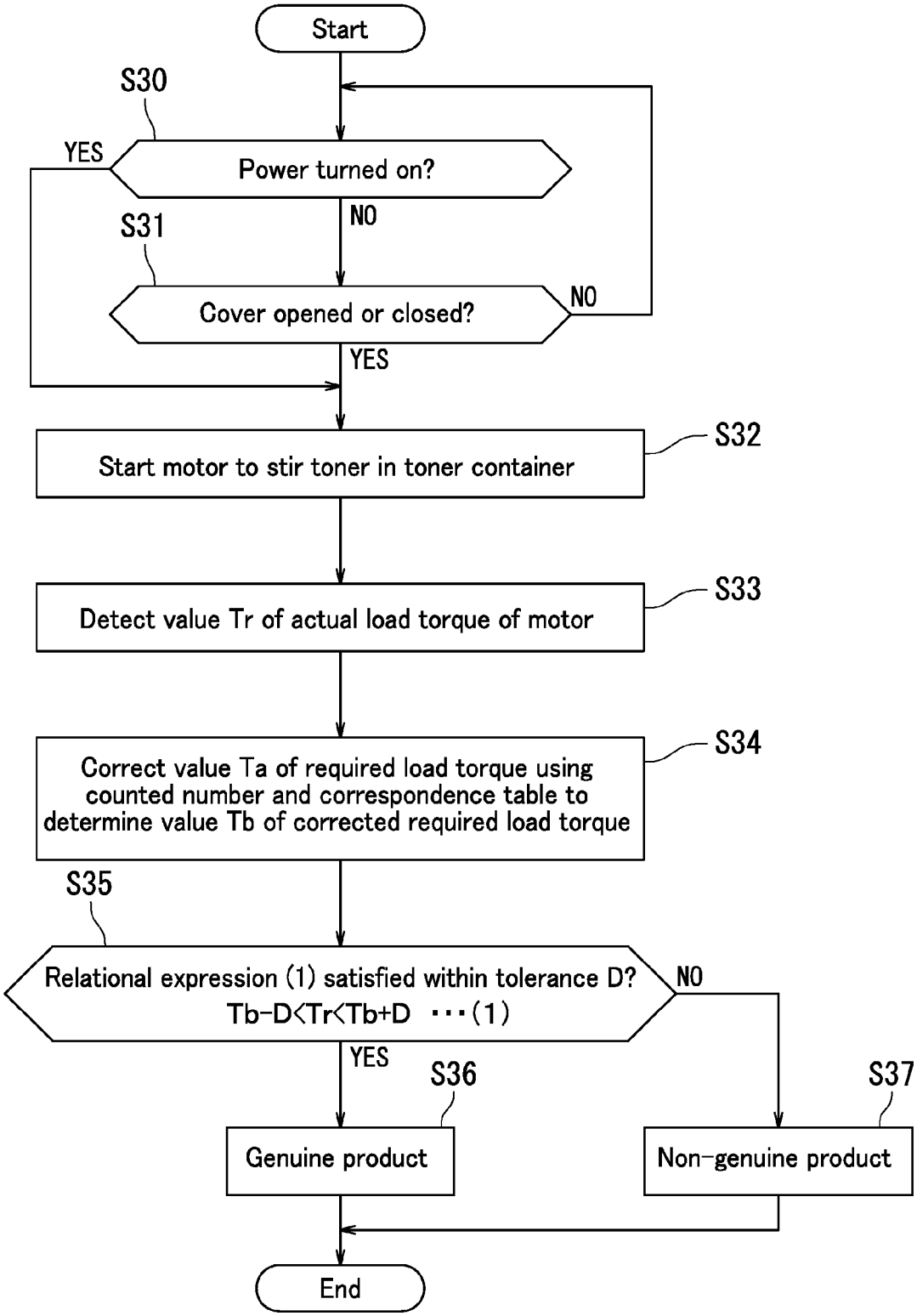
FIG. 7 is a flowchart illustrating operation for determining whether or not a toner container mounted in the image forming apparatus is a genuine product.

The following describes operation of the image forming apparatus 1 with reference to FIGS. 5 to 7. FIG. 5 is a flowchart illustrating a procedure for mounting a toner container 7 in the image forming apparatus 1. FIG. 6 is a flowchart illustrating operation of the counting section 196*b*. FIG. 7 is a flowchart illustrating operation for determining whether or not a toner container 7 mounted in the image forming apparatus 1 is a genuine product.

First, the procedure for mounting a toner container 7 in the image forming apparatus 1 will be described with reference to FIG. 5.

In Step S1, a user prepares a new toner container 7. The user then inputs a value of the required load torque printed on the label 76 of the prepared toner container 7 into the operation input section 192. More specifically, the user inputs the value of the required load torque into the operation input section 192 in association with a toner color of the prepared toner container 7. The procedure subsequently proceeds to Step S2.

In Step S2, the user opens the toner container cover of the image forming apparatus 1. The user then mounts the prepared toner container 7 in one of the mounting sections 3*a* of the image forming apparatus 1 that corresponds to the toner color of the toner container 7. The user then closes the toner container cover. The procedure subsequently proceeds to step S3.

In Step S3, the value of the required load torque and the information of the toner color that have been associated with one another and input into the operation input section 192 are stored in the storage device 196*a*. The procedure then comes to an end. The order of Step S1 and Step S2 may be switched.

Next, operation of the counting section 196*b* will be described with reference to FIG. 6. The following describes an example in which the number is counted with respect to a toner container 7 of a black toner. The number is counted with respect to toner containers 7 of the other toner colors (i.e., cyan, magenta, and yellow) in the same manner as in the case of the toner container 7 of the black toner, and therefore description thereof will be omitted.

In Step S20, the counting section 196*b* determines whether or not the toner container 7 of the black color has been mounted in the corresponding mounting section 3*a* of the image forming apparatus 1 based on a detection signal from the mounting detecting sensor 194. When a result of the determination is negative (No), Step S20 is repeated. When the result of the determination is positive (Yes), the procedure proceeds to Step S21.

In Step S21, the counting section 196*b* resets the counted number to zero with respect to the toner container 7 of the black toner and stores the reset counted number in the storage device 196*a*. The procedure subsequently proceeds to Step S22.

In Step S22, the counting section 196*b* determines whether or not the image forming section 9 has formed an image on one sheet of paper. When a result of the determination is negative (No), Step S22 is repeated. When the result of the determination is positive (Yes), the procedure proceeds to Step S23.

In Step S23, the counting section 196*b* determines whether or not the black toner has been used for the image formation in Step S22. The determination is for example made based on whether or not the image forming unit 91 corresponding to the black toner has performed an image formation process. When a result of the determination is negative (No), the procedure returns to Step S22. When the result of the determination is positive (Yes), the procedure proceeds to Step S24.

In Step S24, the counting section 196*b* increases the counted number by one with respect to the toner container 7 of the black toner and stores the increased counted number in the storage device 196*a*. The procedure subsequently returns to Step S22.

Likewise, every time the image forming section 9 forms an image on one sheet of paper (Step S22), the counted number is increased by one with respect to the toner container 7 of the black toner so long as the black toner is used for the image formation (Yes in Step S23). The increased counted number is stored in the storage device 196*a* (Step S24).

The following describes operation for determining whether or not each toner container 7 mounted in the image forming apparatus 1 is a genuine product with reference to FIG. 7. For the purpose of illustration, the following describes an example in which whether or not a toner container 7 of a black toner is a genuine product is determined. Whether or not toner containers 7 of the other colors (i.e., cyan, magenta, and yellow) are genuine products is determined in the same manner as in the case of the toner container 7 of the black toner, and therefore description thereof will be omitted.

When it is determined in Step S30 that the image forming apparatus 1 has been turned on (i.e., the power switch 193 has been switched from an off state to an on state) (Yes), the procedure proceeds to Step S32. When it is determined in Step S30 that the image forming apparatus 1 is off (i.e., the power switch 193 has not been switched from an off state to an on state) (No), the procedure proceeds to Step S31.

When it is determined in Step S31 that opening or closing of the toner container cover has been performed (i.e., the cover opening and closing detecting sensor 195 has been switched from an off state to an on state or from an on state to an off state) (Yes), the procedure proceeds to Step S32. When it is determined in Step S31 that opening or closing of the toner container cover has not been performed (i.e., the cover opening and closing detecting sensor 195 has not been switched from an off state to an on state or from an on state to an off state) (No), the procedure returns to Step S30.

In Step S32, the motor controller 196*c* controls the drive circuit 191 to start the motor 17. The motor 17 thereby causes rotation of the stirring member 73 of the toner container 7 of the black color. As a result, detection by the load detecting section 196*d* is enabled. The procedure subsequently proceeds to Step S33.

In Step S33, the load detecting section 196*d* measures the drive electric current of the motor 17 while the motor 17 is operating as described in Step S32. The load detecting section 196*d* then detects the value Tr of the actual load torque of the motor 17 based on the drive electric current measured. The procedure subsequently proceeds to Step S34.

In Step S34, the load correction section 196*e* corrects the value Ta of the required load torque stored in the storage device 196*a* based on the counted number stored in the storage device 196*a* (the latest number (for example, N1)) and the correspondence table 18. This counted number is the number counted with respect to the toner container 7 of the black toner. The value Ta is the value stored in the storage device 196*a* in association with the black toner color. More specifically, the load correction section 196*e* determines the difference $\Delta T$ (=T0−T1) based on the correspondence table 18. Next, the load correction section 196*e* determines a value Tb (=Ta−ΔT) of the corrected required load torque. The difference ΔT is a difference between the value T1 of the load torque and the value T0 of the load torque. The value T1 is a value of the load torque when the counted number is N1. The value T0 is a value of the load torque when the counted number is zero. The procedure subsequently proceeds to Step S35.

In Step S35, the determination section 196*f* determines whether or not the value Tr coincides with the value Tb within the predetermined tolerance D. The value Tr is a value detected as a result of Step S33. The value Tb is a value determined as a result of Step S34. More specifically, the determination section 196*f* determines whether or not the value Tr satisfies the relational expression (1).

When a result of the determination in Step S35 is positive (Yes), the procedure proceeds to Step S36, and the determination section 196*f* determines that the toner container 7 of the black toner is a genuine product. The procedure then comes to an end. When the result of the determination in Step S35 is Negative (No), the procedure proceeds to Step S37, and the determination section 196*f* determines that the toner container of the black toner is a non-genuine product. The procedure then comes to an end.

An embodiment of the present disclosure has been described above with reference to the drawings (FIGS. 1 to 7). However, the present disclosure is not limited to the above embodiment and may be practiced in various forms without deviating from the essence thereof (for example, as described below in sections (1) to (5)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiment, such as materials, shapes, and dimensions, are merely examples and are not intended as specific limitations. Various alterations may be made so long as there is no substantial deviation from the effects of the present disclosure.

(1) In the embodiment of the present disclosure, the load detecting section 196*d* may detect the actual load torque of each motor 17 after the motor 17 has operated for a specific period of time. It is likely that the stirring resistance that the stirring member 73 receives from the toner is unstable immediately after the motor 17 is started up, and accordingly the actual load torque of the motor 17 is unstable. After the motor 17 has operated for a specific period of time, the stirring resistance becomes stable and the actual load torque of the motor 17 becomes stable. As a result, the actual load torque of the motor 17 can be detected accurately.

Figure 8:
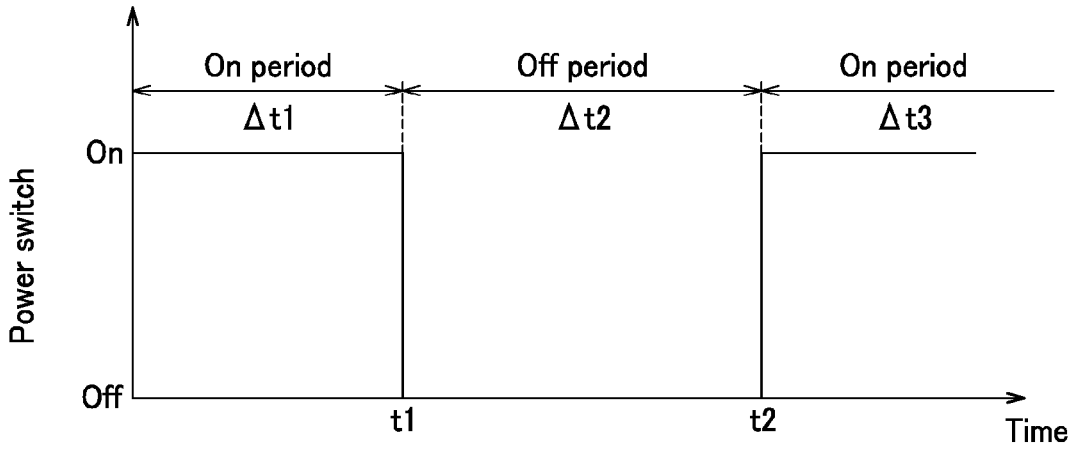
FIG. 8 is a diagram illustrating an example of switching between an on state and an off state of a power switch.

(2) FIG. 8 is a diagram illustrating an example of switching between an on state and an off state of the power switch 193. In the embodiment of the present disclosure, whether or not a toner container 7 has been replaced during an off period Δt2 in which the power switch 193 is off may be determined immediately after time t2 at which the power switch 193 is switched from an off state to an on state as illustrated in FIG. 8.

The following provides more detailed description using an example in which whether or not a toner container 7 of a black toner has been replaced during the off period Δt2 is determined. Whether or not toner containers 7 of the other colors (i.e., cyan, magenta, and yellow) have been replaced is determined in the same manner as in the case of the toner container 7 of the black toner, and therefore description thereof will be omitted.

The motor controller 196*c* periodically starts the motor 17 during an on period Δt1 in which the power switch 193 is on so that the load detecting section 196*d* detects the actual load torque of the motor 17. The motor 17 is a motor for causing rotation of the stirring member 73 of the toner container 7 of the black color. The thus detected value Tr of the actual load torque is stored in the storage device 196*a*.

The power switch 193 is switched to an off state at time t1 and is switched back to an on state at time t2. Immediately after time t2, the motor controller 196*c* starts the motor 17, and the load detecting section 196*d* detects the actual load torque of the motor 17.

The determination section 196*f* compares the value Tr1 of the actual load torque (first actual load value) with the value Tr2 of the actual load torque (second actual load value) to determine whether or not the value Tr1 coincides with the value Tr2. The value Tr1 is the value Tr of the actual load torque immediately before the power switch 193 is switched to an off state (immediately before time t1). The value Tr2 is the value Tr of the actual load torque immediately after the power switch 193 is switched to an on state (immediately after time t2).

Note that the value Tr1 is a value that is detected at time nearest to time t1 during the on period Δt1 among values Tr stored in the storage device 196*a*. The value Tr1 is a value of the actual load torque immediately before the starting time t1 of the off period Δt2. The value Tr2 is a value of the actual load torque immediately after the ending time t2 of the off period Δt2.

If the value Tr1 coincides with the value Tr2, the determination section 196*f* determines that the toner container 7 of the black toner has not been replaced during the off period Δt2. In this case, the determination section 196*f* determines that the toner container 7 is a genuine product. If the value Tr1 does not coincide with the value Tr2, the determination section 196*f* determines that the toner container 7 of the black toner has been replaced during the off period Δt2. In this case, the determination section 196*f* determines that the toner container 7 is a non-genuine product.

(3) In the embodiment of the present disclosure, the determination section 196*f* may determine whether or not a toner container 7 is a genuine product using the value Ta of the required load torque instead of the value Tb of the corrected required load torque. That is, the determination section 196*f* may determine whether or not the toner container 7 is a genuine product by comparing the value Tr of the actual load torque with the value Ta of the required load torque and determining whether or not the value Tr coincides with the value Ta. In this case, the determination section 196*f* preferably performs the determination immediately after the toner container 7 is mounted in the image forming apparatus 1 (i.e., before the toner in the toner container 7 is consumed).

(4) In the embodiment of the present disclosure, the determination section 196*f* may determine whether or not a toner container 7 is a genuine product by comparing the value Tr of the actual load torque with the value Tb of the corrected required load torque and determining whether or not the value Tr coincides with the value Tb without using the tolerance D. Practical levels of accuracy can be ensured in the determination even without the tolerance D.

(5) In the embodiment of the present disclosure, whether or not a toner container 7 is a genuine product is determined upon opening or closing of the toner container cover. However, the present disclosure is not limited to the embodiment. In a configuration in which the housing 3 includes for example a cover for jam cleaning or a cover for maintenance in addition to the toner container cover, the determination may be made upon opening or closing of such a cover.

What is claimed is:

1. An image forming apparatus comprising:

a housing;

a toner container configured to be removably mounted in the housing and contain a toner, the toner container having a stirring member for stirring the toner;

an electric motor configured to drive the stirring member;

a storage device configured to store a required load value set for the toner container;

a load detecting section including an electric current sensor that measures a drive electric current of the electric motor, the load detecting section being configured to detect an actual load value of the electric motor in driving of the stirring member based on the drive electric current measured;

a determination section configured to compare the actual load value detected by the load detecting section with the required load value stored in the storage device and determine whether or not the actual load value coincides with the required load value to determine whether or not the toner container mounted in the housing is a genuine product; and an operation input section having a touch panel or hard keys that receive input of the required load value, wherein the storage device stores the required load value input in the operation input section.

2. The image forming apparatus according to claim 1, wherein the toner container has a label indicating the required load value.

3. The image forming apparatus according to claim 1, wherein the toner container has a torque limiter, and the torque limiter allows rotation of the stirring member when a torque no less than a specific threshold value is applied to the stirring member and does not allow rotation of the stirring member when a torque less than the specific threshold value is applied to the stirring member.

4. The image forming apparatus according to claim 1, further comprising:

an image forming section configured to form an image on paper using the toner contained in the toner container, the image forming section having conveyance rollers that convey the paper;

a counting section configured to count the number of sheets of the paper on which an image has been formed by the image forming section;

a variation table predefining variation of load value of the electric motor depending on the number counted by the counting section; and a load correction section configured to determine a difference between the load value when the counted number is zero and the load value when the counted number is a latest value based on the variation table and subtract the difference from the required load value to determine a corrected required load value, wherein the determination section compares the actual load value with the corrected required load value and determines whether or not the actual load value coincides with the corrected required load value to determine whether or not the toner container is a genuine product.

5. The image forming apparatus according to claim 1, wherein the determination section determines that the toner container is a genuine product if the actual load value coincides with the required load value within a predetermined tolerance.

6. The image forming apparatus according to claim 1, wherein the load detecting section detects the actual load value of the electric motor after the electric motor has operated for a specific period of time.

7. The image forming apparatus according to claim 1, further comprising a power switch, wherein the load detecting section detects a first actual load value and a second actual load value, the first actual load value being the actual load value immediately before a beginning of an off period in which the power switch is off, the second actual load value being the actual load value immediately after an end of the off period, and the determination section:

compares the second actual load value with the first actual load value;

determines that the toner container has not been replaced during the off period if the second actual load value coincides with the first actual load value; and determines that the toner container has been replaced during the off period if the second actual load value does not coincide with the first actual load value.

8. The image forming apparatus according to claim 1, further comprising:

a power switch; and a cover opening and closing detecting sensor configured to detect opening and closing of a toner container cover, wherein the load detecting section detects the actual load value of the electric motor in driving of the stirring member upon the power switch being turned on or upon the cover opening and closing detecting sensor detecting opening or closing of the toner container cover.

9. The image forming apparatus according to claim 2, wherein the toner container further includes a container main body and a packing surrounding the container main body, and the label is provided on a surface of the container main body or on a surface of the packing.

10. The image forming apparatus according to claim 3, wherein the required load value is a sum of the specific threshold value and a value of Stirring resistance, and the stirring resistance is resistance that the stirring member receives from the Toner during rotation of the stirring member.

11. An image forming apparatus comprising:

a housing;

a toner container configured to be removably mounted in the housing and contain a toner, the toner container having a stirring member for stirring the toner;

an electric motor configured to drive the stirring member;

a storage device configured to store a required load value set for the toner container;

a load detecting section including an electric current sensor that measures a drive electric current of the electric motor, the load detecting section being configured to detect an actual load value of the electric motor in driving of the stirring member based on the drive electric current measured; and a determination section configured to compare the actual load value detected by the load detecting section with the required load value stored in the storage device and determine whether or not the actual load value coincides with the required load value to determine whether or not the toner container mounted in the housing is a genuine product, wherein the determination section determines that the toner container is a genuine product if the actual load value coincides with the required load value within a predetermined tolerance.

12. The image forming apparatus according to claim 11, wherein the toner container has a torque limiter, and the torque limiter allows rotation of the stirring member when a torque no less than a specific threshold value is applied to the stirring member and does not allow rotation of the stirring member when a torque less than the specific threshold value is applied to the stirring member.

13. The image forming apparatus according to claim 12, wherein the required load value is a sum of the specific threshold value and a value of stirring resistance, and the stirring resistance is resistance that the stirring member receives from the toner during rotation of the stirring member.

14. The image forming apparatus according to claim 11, further comprising:

an image forming section configured to form an image on paper using the toner contained in the toner container, the image forming section having conveyance rollers that convey the paper;

a counting section configured to count the number of sheets of the paper on which an image has been formed by the image forming section;

a variation table predefining variation of load value of the electric motor depending on the number counted by the counting section; and a load correction section configured to determine a difference between the load value when the counted number is zero and the load value when the counted number is a latest value based on the variation table and subtract the difference from the required load value to determine a corrected required load value, wherein the determination section compares the actual load value with the corrected required load value and determines whether or not the actual load value coincides with the corrected required load value to determine whether or not the toner container is a genuine product.

15. The image forming apparatus according to claim 11, wherein the load detecting section detects the actual load value of the electric motor after the electric motor has operated for a specific period of time.

16. The image forming apparatus according to claim 11, further comprising a power switch, wherein the load detecting section detects a first actual load value and a second actual load value, the first actual load value being the actual load value immediately before a beginning of an off period in which the power switch is off, the second actual load value being the actual load value immediately after an end of the off period, and the determination section:

compares the second actual load value with the first actual load value;

determines that the toner container has not been replaced during the off period if the second actual load value coincides with the first actual load value; and determines that the toner container has been replaced during the off period if the second actual load value does not coincide with the first actual load value.

17. The image forming apparatus according to claim 11, further comprising:

a power switch; and a cover opening and closing detecting sensor configured to detect opening and closing of a toner container cover, wherein the load detecting section detects the actual load value of the electric motor in driving of the stirring member upon the power switch being turned on or upon the cover opening and closing detecting sensor detecting opening or closing of the toner container cover.

18. An image forming apparatus comprising:

a housing;

a toner container configured to be removably mounted in the housing and contain a toner, the toner container having a stirring member for stirring the toner;

an electric motor configured to drive the stirring member;

a storage device configured to store a required load value set for the toner container;

a load detecting section including an electric current sensor that measures a drive electric current of the electric motor, the load detecting section being configured to detect an actual load value of the electric motor in driving of the stirring member based on the drive electric current measured;

a determination section configured to compare the actual load value detected by the load detecting section with the required load value stored in the storage device and determine whether or not the actual load value coincides with the required load value to determine whether or not the toner container mounted in the housing is a genuine product;

a power switch; and a cover opening and closing detecting sensor configured to detect opening and closing of a toner container cover, wherein the load detecting section detects the actual load value of the electric motor in driving of the stirring member upon the power switch being turned on or upon the cover opening and closing detecting sensor detecting opening or closing of the toner container cover.

19. The image forming apparatus according to claim 18, wherein the toner container has a torque limiter, and the torque limiter allows rotation of the stirring member when a torque no less than a specific threshold value is applied to the stirring member and does not allow rotation of the stirring member when a torque less than the specific threshold value is applied to the stirring member.

20. The image forming apparatus according to claim 19, wherein the required load value is a sum of the specific threshold value and a value of stirring resistance, and the stirring resistance is resistance that the stirring member receives from the toner during rotation of the stirring member.

* * * * *